US009329563B2

(12) United States Patent
Mochizuki

(10) Patent No.: US 9,329,563 B2
(45) Date of Patent: May 3, 2016

(54) IMAGE FORMING APPARATUS FOR REMOVING A DEVELOPER FROM A MEMEBER TO BE CLEANED

(71) Applicant: CANON KABUSHIKI KAISHA, Tokyo (JP)

(72) Inventor: Masataka Mochizuki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/191,076

(22) Filed: Feb. 26, 2014

(65) Prior Publication Data

US 2014/0241773 A1 Aug. 28, 2014

(30) Foreign Application Priority Data

Feb. 28, 2013 (JP) ..... 2013-039183

(51) Int. Cl.
*G03G 21/00* (2006.01)

(52) U.S. Cl.
CPC .... *G03G 21/0029* (2013.01); *G03G 2221/1618* (2013.01)

(58) Field of Classification Search
CPC ..... G03G 21/0029; G03G 2221/1618
See application file for complete search history.

(56) References Cited

U.S. PATENT DOCUMENTS

| | | | | |
|---|---|---|---|---|
| 5,470,635 | A | 11/1995 | Shirai | |
| 6,079,084 | A * | 6/2000 | Gwynn | 24/350 |
| 2008/0003013 | A1 * | 1/2008 | Martin et al. | 399/109 |
| 2010/0272484 | A1 * | 10/2010 | Morishita | 399/351 |
| 2013/0223905 | A1 * | 8/2013 | Kase | 399/351 |

FOREIGN PATENT DOCUMENTS

EP 0546751 A2 * 6/1993

* cited by examiner

*Primary Examiner* — David Gray
*Assistant Examiner* — Laura Roth
(74) *Attorney, Agent, or Firm* — Canon USA Inc. IP Division

(57) ABSTRACT

A cleaning member for removing a developer from a surface of a member to be cleaned includes a blade member configured to make contact with the member to be cleaned in a direction counter to a moving direction of the member to be cleaned, and a flexible plate-like supporting member configured to support the blade member, which includes one end with the blade member, the other end with a fixed portion fixed to a frame member, and a bent portion between the ends which is located outwardly away from the surface of the member to be cleaned relative to a segment connecting the fixed portion and a contact portion between the blade member and the member to be cleaned. The fixed portion arranged downstream of the moving direction of the member to be cleaned relative to the contact portion has a folded-back shape to nip part of the frame member.

21 Claims, 10 Drawing Sheets

IMAGE FORMING APPARATUS FOR REMOVING A DEVELOPER FROM A MEMEBER TO BE CLEANED

BACKGROUND OF THE INVENTION

1. Field of the Invention

The present invention relates to a cleaning member for removing a developer from a member to be cleaned.

2. Description of the Related Art

An electrophotographic image forming apparatus repeatedly uses an image bearing member (a member to be cleaned) on which a developer image is to be formed. Thus, the electrophotographic image forming apparatus includes a cleaning unit for removing a developer remaining on the image bearing member after the developer image has been transferred from the image bearing member onto a recording medium. A cleaning blade type cleaning unit is configured to bring an flexible blade into contact with the surface of the image bearing member with predetermined pressure to remove a developer from the surface of the image bearing member. A cleaning member discussed in U.S. Pat. No. 5,470,635 has a structure where a blade is attached to a leading end of a plate metal, which is a supporting member, by molding. The plate metal is attached and fixed to a frame member with screws or the like to bring the blade into contact with the surface of the image bearing member with predetermined pressure.

There is demand for the downsizing, the speeding up, and a higher image quality of an image forming apparatus such as a printer. The downsizing of the image forming apparatus also leads to the downsizing of an image bearing member. Further, the speeding up of the image forming apparatus increases the rotational speed of the image bearing member. Thus, a blade in contact with the surface of the image bearing member repeatedly slides in contact with the surface of the image bearing member at high speed. This may raise the temperature of the blade, and may reduce the hardness of the blade. As a result, the frictional force between the surface of the image bearing member and the blade may increase, leading to an increase in the driving torque for driving the image bearing member and a turning-up of the blade. Further, recently, to achieve a higher image quality, a developer containing spherical particles may be used. In this case, to remove the developer from the surface of the image bearing member, it is necessary to increase the contact pressure of the blade on the image bearing member. This may become a factor that exacerbates the above problems.

SUMMARY OF THE INVENTION

The present invention is directed to a technique capable of stabilizing the contact of a blade member with a member to be cleaned.

According to an aspect of the present invention, a cleaning member for removing a developer from a surface of a member to be cleaned includes a blade member configured to come into contact with the member to be cleaned in a direction counter to a moving direction of the member to be cleaned, and a flexible plate-like supporting member configured to support the blade member. The supporting member includes one end portion, in which the blade member is provided, the other end portion, which has a fixed portion fixed to a frame member, and a bent portion, which is located between the one end portion and the other end portion and located outwardly away from the surface of the member to be cleaned with respect to a line segment connecting the fixed portion and a contact portion, in which the blade member comes into contact with the member to be cleaned. The fixed portion is arranged downstream of the moving direction of the member to be cleaned relative to the contact portion, and has a folded-back shape that allows a part of the frame member to be nipped.

According to another aspect of the present invention, a cleaning device for use in an image forming apparatus includes (i) a frame member, (ii) a cleaning member for removing a developer from a surface of a member to be cleaned, and (iii) a storage member configured to store the developer removed from the member to be cleaned by the cleaning member. The cleaning member includes a blade member configured to come into contact with the member to be cleaned in a direction counter to a moving direction of the member to be cleaned, and a flexible plate-like supporting member configured to support the blade member. The supporting member includes one end portion, in which the blade member is provided, the other end portion, which has a fixed portion fixed to the frame member, and a bent portion, which is located between the one end portion and the other end portion and located outwardly away from the surface of the member to be cleaned with respect to a line segment connecting the fixed portion and a contact portion, in which the blade member comes into contact with the member to be cleaned. The fixed portion is arranged downstream of the moving direction of the member to be cleaned relative to the contact portion, and has a folded-back shape that allows a part of the frame member to be nipped.

According to yet another aspect of the present invention, a process cartridge attachable to and detachable from an image forming apparatus includes (i) a photosensitive member, (ii) a frame member, and (iii) a cleaning member for removing a developer from a surface of the photosensitive member. The cleaning member includes a blade member configured to come into contact with the photosensitive member in a direction counter to a moving direction of the photosensitive member, and a flexible plate-like supporting member configured to support the blade member. The supporting member includes one end portion, in which the blade member is provided, the other end portion, which has a fixed portion fixed to the frame member, and a bent portion, which is located between the one end portion and the other end portion and located outwardly away from the surface of the photosensitive member with respect to a line segment connecting the fixed portion and a contact portion, in which the blade member comes into contact with the photosensitive member. The fixed portion is arranged downstream of the moving direction of the photosensitive member relative to the contact portion, and has a folded-back shape that allows a part of the frame member to be nipped.

According to yet another aspect of the present invention, an image forming apparatus for forming an image on a recording medium using a developer includes (i) a member to be cleaned, (ii) a frame member, and (iii) a cleaning member for removing a developer from a surface of the member to be cleaned. The cleaning member includes a blade member configured to come into contact with the member to be cleaned in a direction counter to a moving direction of the member to be cleaned, and a flexible plate-like supporting member configured to support the blade member. The supporting member includes one end portion, in which the blade member is provided, the other end portion, which has a fixed portion fixed to the frame member, and a bent portion, which is located between the one end portion and the other end portion and located outwardly away from the surface of the member to be cleaned with respect to a line segment connecting the fixed portion and a contact portion, in which the blade member comes into contact with the member to be cleaned. The fixed portion is arranged downstream of the moving direction of the member to be cleaned relative to the contact portion, and has a folded-back shape that allows a part of the frame member to be nipped.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings. However, the dimensions, the materials, and the shapes of components described in the exemplary embodiments and the relative arrangement of these components should be appropriately changed depending on the configuration of an apparatus to which the invention is applied and various conditions. That is, the scope of the invention is not limited to the following exemplary embodiments.

[Configuration of Image Forming Apparatus]

Figure 9:
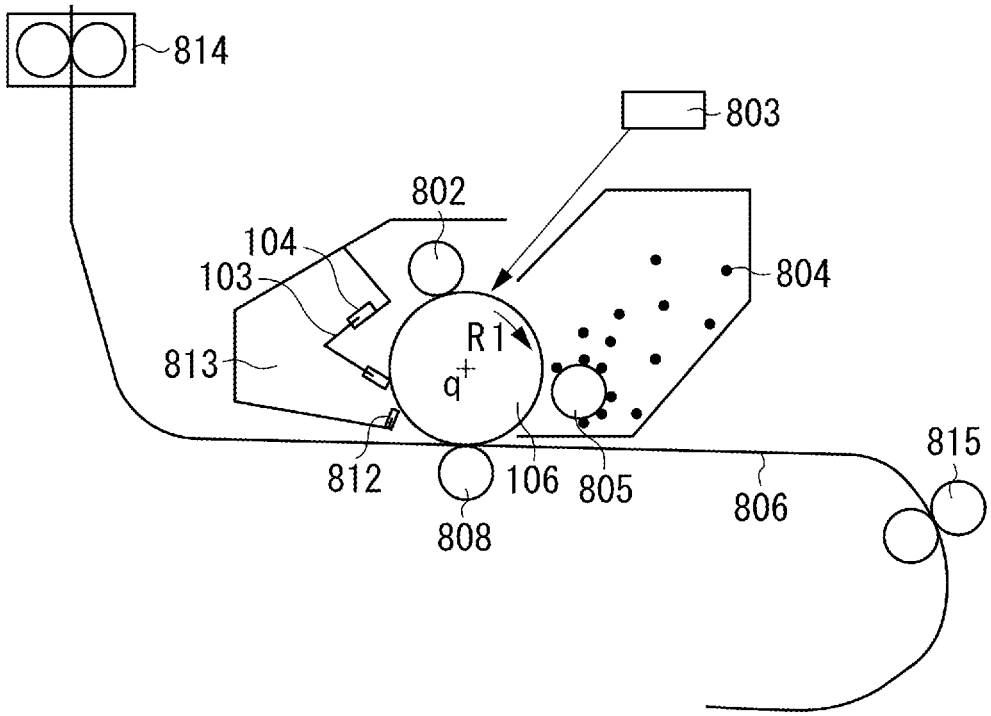
FIG. 9 is a schematic cross-sectional view illustrating a configuration of an image forming apparatus according to the first exemplary embodiment.

FIG. 9 is a schematic cross-sectional view illustrating the configuration of an image forming apparatus according to a first exemplary embodiment of the present invention. The image forming apparatus according to the first exemplary embodiment forms an image on a recording medium by an electrophotographic method. Examples of the image forming apparatus include electrophotographic copying machines, laser beam printers, light-emitting diode (LED) printers, and facsimile apparatuses. The image forming apparatus according to the first exemplary embodiment is a monochrome laser beam printer. Further, the image forming apparatus according to the first exemplary embodiment employs a process cartridge method. The process cartridge method refers to the method of integrating at least an image bearing member and a cleaning device into a cartridge to be attachable to and detachable from the main body of the image forming apparatus.

FIG. 9 illustrates only main components directly related to image formation in the image forming apparatus according to the first exemplary embodiment, and does not illustrate a frame member and the like. The components not illustrated in FIG. 9 are similar to those of the conventional art, and therefore are not described, either. A drum-type image bearing member (photosensitive drum) 106, which is a member to be cleaned, is arranged near the approximate center of the image forming apparatus and supported by the frame member (not illustrated) to be rotationally movable. The image bearing member 106 is obtained by forming an organic photoconductor (OPC) photosensitive layer on the outer peripheral surface of a conductive drum substrate made of aluminum or the like. The image bearing member 106 is driven to rotate about an axis q in the direction of an arrow R1 at a predetermined speed (peripheral velocity). The surface (the peripheral surface) of the image bearing member 106 is uniformly subjected to a charging process by a charging roller 802, which is a charging unit, so that the surface of the image bearing member 106 has a predetermined polarity and a predetermined potential. After the charging process, the surface of the image bearing member 106 is exposed to a laser beam being output from a laser scanner 803 serving an exposure unit and corresponding to an electric digital pixel signal of image information. Consequently, an electrostatic latent image corresponding to the image information is formed on the surface of the image bearing member 106. A developer 804 is attached to the surface of the image bearing member 106 by a developing device 805, which is a developing unit. Consequently, the electrostatic latent image formed on the surface of the image bearing member 106 is developed as a developer image (a toner image or a developed image). A recording material 806 fed by sheet feeding rollers 815 is sent to a transfer nip portion between a transfer roller 808, which is a transfer unit, and the image bearing member 106. Then, the developer image developed on the surface of the image bearing member 106 is transferred onto the recording material 806. The recording material 806 onto which the developer image has been transferred is conveyed to a fixing device 814, which is a fixing unit. Then, the developer 804 is fixed on the recording material 806. After the transfer of the developer image, the developer 804 that has not been transferred onto the recording material 806 and remains on the surface of the image bearing member 106 is removed by a cleaning member 103, which is a cleaning device. Then, the image formation transitions to the next image formation.

The cleaning device includes the cleaning member 103, which comes into contact with the surface of the image bearing member 106 to scrape off a remaining developer (hereinafter referred to as "waste toner"), and a housing member 104, to which the cleaning member 103 is fixed. The housing member 104 is a member forming a part of the frame member (not illustrated) that rotatably supports the image bearing member 106. Examples of the frame member to which the cleaning member 103 is fixed may include, for example, a frame member of the main body of the apparatus, a frame member of the process cartridge, or a frame member of the cleaning device, depending on the configuration of the apparatus. The cleaning device further includes a scooping sheet 812, which comes into contact with the surface of the image bearing member 106 to scoop the waste toner scraped off by the cleaning member 103, and a cleaning container (a storage member) 813, which stores the scooped waste toner.

[Configuration of Cleaning Member]

Figure 4:
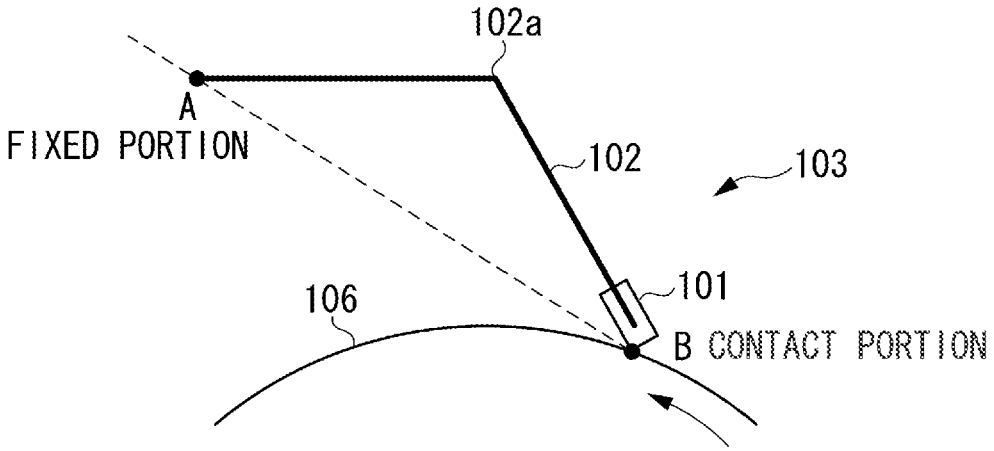
FIG. 4 is a schematic diagram illustrating a configuration of the cleaning member according to the first exemplary embodiment.
Figure 5:
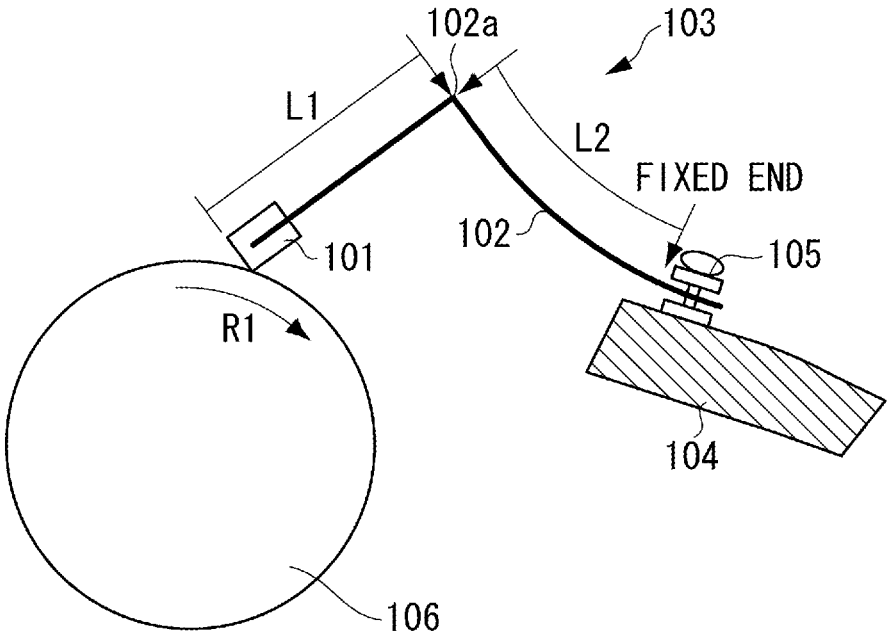
FIG. 5 is a schematic diagram illustrating an overall configuration of the cleaning member according to the first exemplary embodiment.
Figure 6:
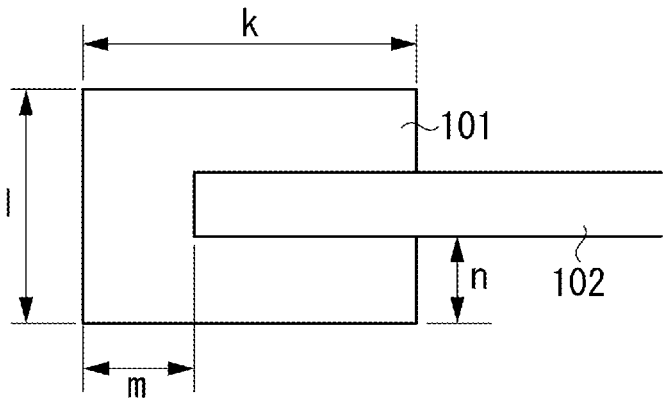
FIG. 6 is a schematic cross-sectional view illustrating a configuration of a leading end portion of the cleaning member according to the first exemplary embodiment.

With reference to FIGS. 4 to 6, the configuration of the cleaning member 103 will be described. FIG. 4 is a schematic diagram illustrating the configuration of the cleaning member 103 according to the first exemplary embodiment. FIG. 5 is a schematic diagram illustrating the overall configuration of the cleaning member 103 according to the first exemplary embodiment. FIG. 6 is a schematic cross-sectional view illustrating the configuration of a leading end portion of the cleaning member 103 according to the first exemplary embodiment.

As illustrated in FIG. 4, the cleaning member 103 according to the first exemplary embodiment includes a flexible plate-like supporting member 102, which extends in a direction counter to the moving direction of the image bearing member 106, and a blade-like rubber member (blade member) 101 provided in a leading end portion of the supporting member 102. The supporting member 102 is bent or curved, and is configured such that with respect to a line segment AB connecting a fixed portion A fixed to the housing member 104 and a contact portion B in contact with the image bearing member 106, a bent portion 102*a* that is the closest to the contact portion B is located on the opposite side to the image bearing member 106. That is, the bent portion 102*a* is located outwardly away from the surface of the image bearing member 106 (further away from the surface of the image bearing member 106) with respect to the line segment AB.

As illustrated in FIG. 5, in a leading end portion (one end portion) of the cleaning member 103 that is one end side of the supporting member 102 and comes into contact with the image bearing member 106, a rubber member 101 is integrally molded with the supporting member 102, which is a thin metal plate. Further, the other end side (the other end portion) of the supporting member 102 is fixed to the housing member 104. The supporting member 102 is configured as illustrated in FIG. 4 so that if the friction between the supporting member 102 and the image bearing member 106 has increased and the supporting member 102 has been pushed in, the supporting member 102 deforms near the fixed portion A in the direction of increasing the deformation degree of freedom. This deformation of the supporting member 102 causes the rubber member 101 at the leading end of the supporting member 102 to move away from the image bearing member 106. This can suppress increases in the contact pressure and the frictional force on the image bearing member 106.

In the first exemplary embodiment, the supporting member 102 is a thin plate made of stainless steel and having a thickness of about 0.2 mm, so that the supporting member 102 has spring characteristics. Further, the supporting member 102 is bent 90° uniformly in the direction of the rotational axis of the image bearing member 106. The material of the supporting member 102 can not only be stainless steel but also be, for example, a phosphor bronze plate or another member having spring characteristics. Instead of these metallic plate-like members having spring characteristics, a vibration suppression member having elasticity can be used.

As illustrated in FIG. 6, in the leading end portion of the cleaning member 103 that comes into contact with the surface of the image bearing member 106, the rubber member 101 made of urethane rubber is provided. The shape of the rubber member 101 has the approximate dimensions of k=3.0 mm, l=2.0 mm, m=1.0 mm, and n=1.0 mm. Examples of the method of fixing the rubber member 101 to the cleaning member 103 include methods using molding, a double-sided tape, and a hot-melt adhesive.

As illustrated in FIG. 5, a planar portion from the fixed portion A fixed to the housing member 104 to the 90-degree bent position is defined as a portion L2, and a planar portion from the 90-degree bent position to the rubber member 101 is defined as a portion L1.

[Comparative Example of Method of Fixing Cleaning Member]

Figure 10A:
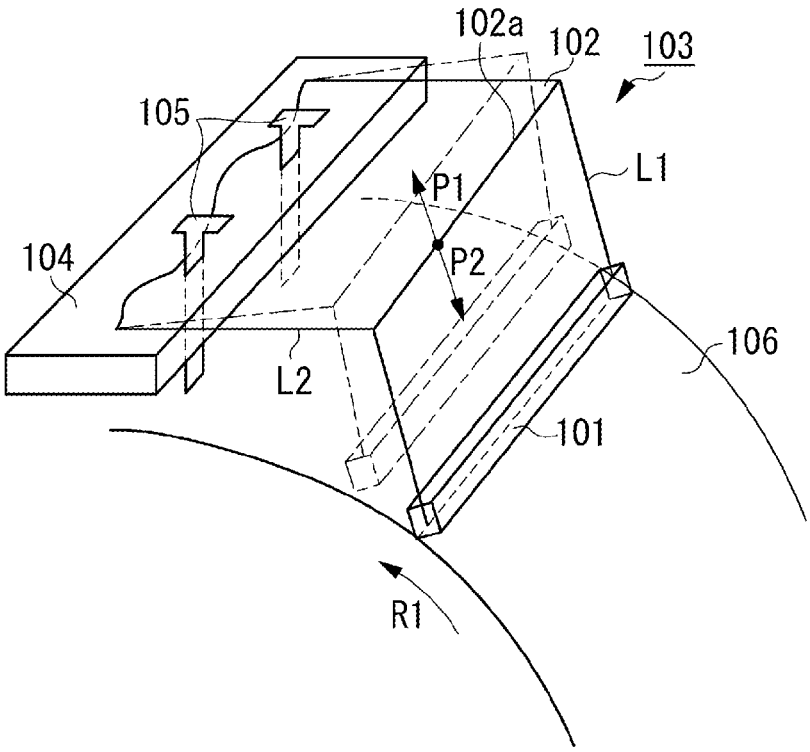
FIGS. 10A and 10B are schematic diagrams illustrating an example of a method of fixing a cleaning member to a housing member.
Figure 10B:
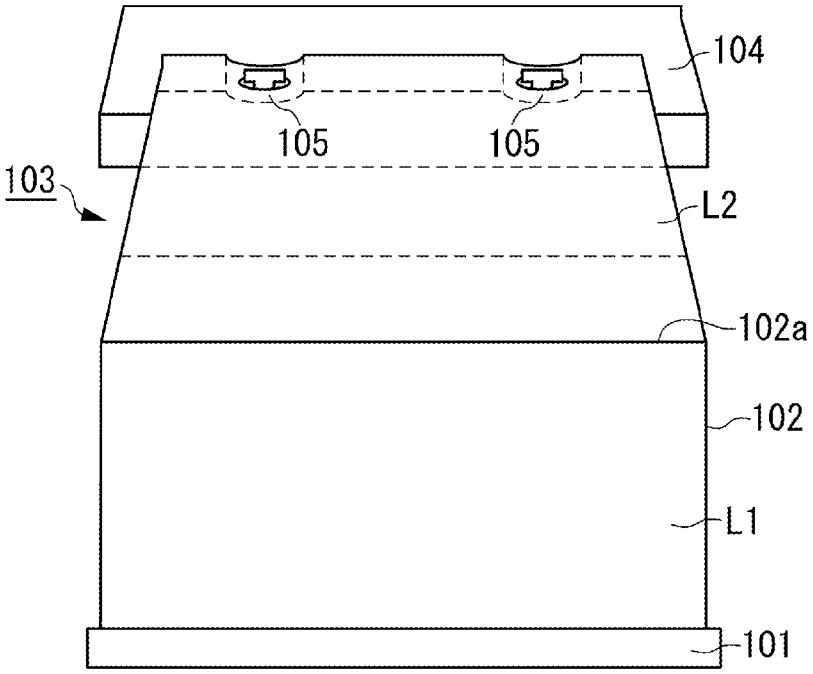

With reference to FIGS. 10A and 10B, an example of the method of fixing the cleaning member 103 will be described as a comparative example. FIGS. 10A and 10B are schematic diagrams illustrating an example of the method of fixing the cleaning member 103 to the housing member 104. FIG. 10A is a schematic perspective view of the configuration to fix the cleaning member 103 in the comparative example. FIG. 10B is a schematic perspective view of the configuration illustrated in FIG. 10A, as viewed from the front and above.

The part between the fixed portion A and the bent portion 102*a* in the supporting member 102 is easily deformable when the fixed portion A is fixed to the housing member 104. This is because the plate metal needs to be thin to secure the flexibility. As illustrated in FIGS. 10A and 10B, the method of fixing the cleaning member 103 may be achieved by fixing an end portion (the fixed portion A) of the supporting member 102 with attachment screws 105, in terms of securely fixing the cleaning member 103 without looseness and preventing changes over time after the attachment.

As illustrated in FIG. 10A, in the cleaning member 103, the supporting member 102 vibrates in directions P1 and P2 to stabilize the contact pressure between the rubber member 101 and the image bearing member 106. If, however, the supporting member 102 is fixed to the housing member 104 with the attachment screws 105, the supporting member 102, which is a thin plate, may deform near the attachment screws 105 in the portion L2 as illustrated in FIG. 10B. The deformation near the attachment screws 105 in the portion L2 of the supporting member 102 significantly increases the bending stress of the supporting member 102 that is required to deform in the directions P1 and P2. An increase in the bending stress in the directions P1 and P2 may prevent the portion L2 from obtaining desired spring characteristics. As a result, the rubber member 101 may not be able to stably come into contact with the image bearing member 106, and therefore may fail to obtain suppressive effects on increases in the contact pressure and the frictional force.

[Method of Fixing Cleaning Member According to First Exemplary Embodiment]

Figure 1:
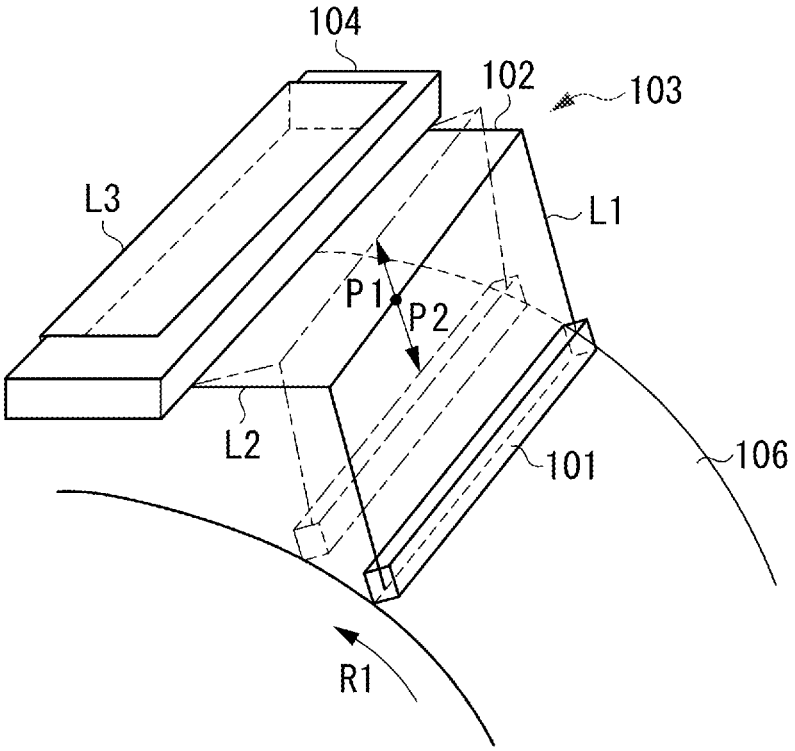
FIG. 1 is a schematic perspective view illustrating a configuration for fixing a cleaning member according to an exemplary embodiment of the present invention.
Figure 2A:
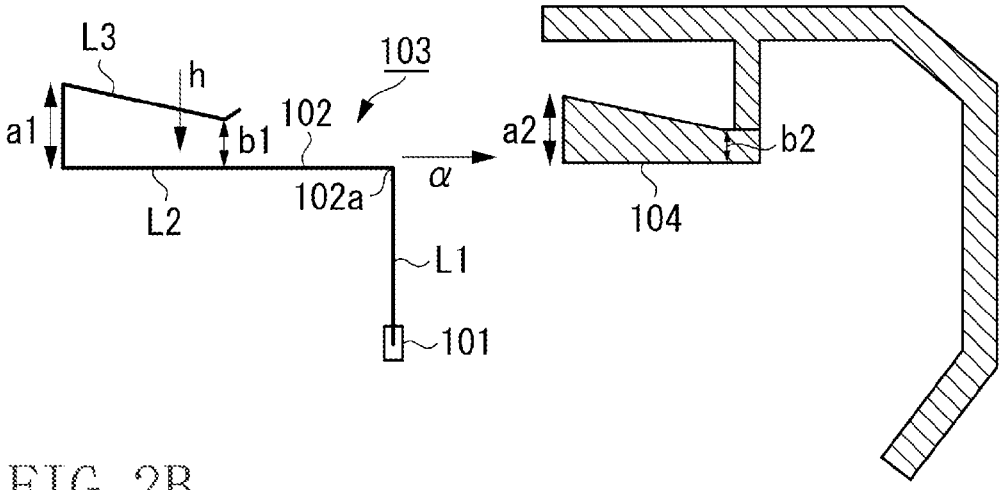
FIGS. 2A, 2B, and 2C are schematic cross-sectional views illustrating a method of fixing the cleaning member according to a first exemplary embodiment of the present invention.
Figure 2B:
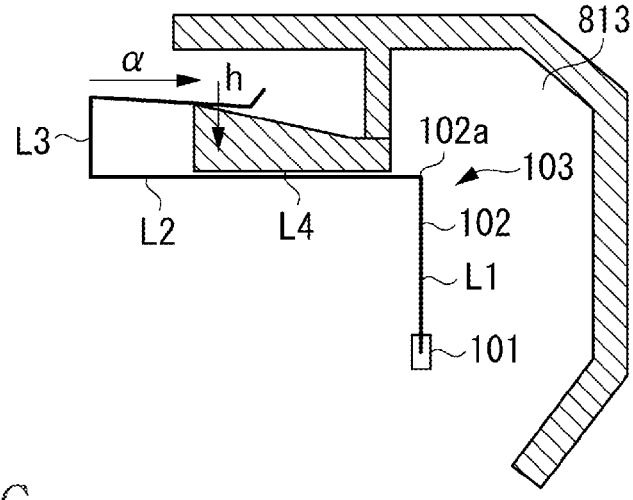
Figure 2C:
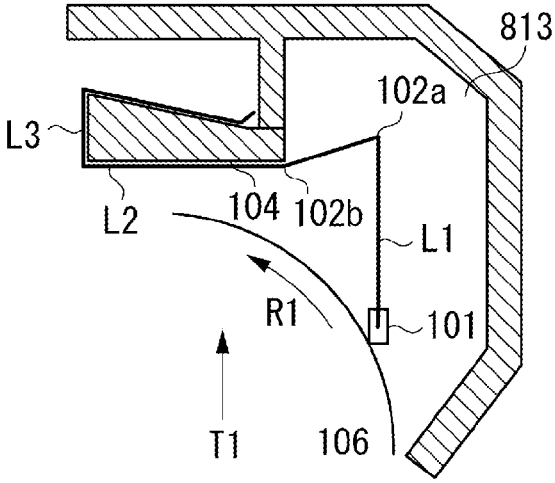

With reference to FIGS. 1, 2A, 2B, and 2C, the method of fixing the cleaning member 103 according to the present exemplary embodiment will be described. FIG. 1 is a schematic perspective view of the configuration to fix the cleaning member 103 according to the present exemplary embodiment. FIGS. 2A, 2B, and 2C are schematic cross-sectional views of the method of fixing the cleaning member 103 according to the first exemplary embodiment, and the method is illustrated in the sequence of steps. Although the configuration illustrated in FIG. 1 is the configuration to fix the cleaning member 103 according to a second exemplary embodiment of the present invention, which will be described later, the configuration to fix the cleaning member 103 according to the first exemplary embodiment is similar to this configuration.

As illustrated in FIG. 1, the fixed portion A of the cleaning member 103 according to the first exemplary embodiment has a bent (folded-back) shape that allows a part of the supporting member 102, which is a plate-like member, to nip the housing member 104, which is a part of the frame member. The housing member 104 is arranged to extend approximately perpendicularly to the direction P1 of the force acting on the cleaning member 103 due to contact with the image bearing member 106.

The fixed portion A includes a first portion, which extends downstream of the moving direction of the image bearing member 106, a second portion, which extends from the leading end of the first portion in a direction away from the image bearing member 106, and a third portion, which extends upstream of the moving direction of the image bearing member 106, from the leading end of the second portion. It can also be said that the first portion extends in a direction away from the bent portion 102*a*, and the third portion extends in a direction toward the bent portion 102*a*. The fixed portion A nips the housing member 104 between the first portion and the third portion, thereby fixing the cleaning member 103 to the housing member 104. In the first exemplary embodiment, in the portion L2, the part in contact with the undersurface of the housing member 104 corresponds to the first portion. In the portion L3, the part standing up perpendicularly from an end portion of the portion L2 corresponds to the second portion, and the part bent approximately parallel to the portion L2 from the standing-up part corresponds to the third portion.

As illustrated in FIG. 2A, the fixed portion A is folded back to accommodate the shape of the housing member 104. In the first exemplary embodiment, the fixed portion A is folded back such that the closer to the leading end of the third portion, the narrower the space between the first portion and the third portion. That is, in a recessed shape formed by bending the portion L3, a width a1 on the bottom side and a width b1 on the opening side have the relationship where a1>b1. Correspondingly, the widths of the housing member 104 are also such that a width a2 of the end portion that comes into contact with the second portion of the fixed portion A and a width b2 of the end portion on the opposite side have the relationship where a2>b2. Further, a1 and a2 are set to sizes corresponding to each other, and b1 and b2 are set to sizes corresponding to each other (the former of each pair is slightly greater in view of ease of assembly). The cleaning member 103 is slid in a direction α in FIG. 2A to insert the housing member 104 into the folded-back portion, thereby attaching the cleaning member 103 to the housing member 104.

As illustrated in FIG. 2B, if the cleaning member 103 has been slid in the direction α, the folded-back portion of the cleaning member 103 deforms in an expanded manner. Consequently, the spring characteristics of the thin plate apply pressure in a direction h. More specifically, the application of the pressure in the direction h suppresses the movement of the cleaning member 103 in a direction opposite to the direction α, that is, the movement of the cleaning member 103 in the direction of coming off the housing member 104. Due to these spring characteristics, the cleaning member 103 is fixed to the housing member 104 by firmly nipping the housing member 104.

As illustrated in FIG. 2C, after the cleaning member 103 has been attached to the housing member 104, the image bearing member 106 is attached to the frame member. The image bearing member 106 is inserted into the frame member in a direction (a direction T1 illustrated in FIG. 2C) opposed to the direction in which the portion L1 of the supporting member 102 of the cleaning member 103 extends. Then, the image bearing member 106 comes into contact with the rubber member 101 of the cleaning member 103 and is attached to the frame member by pushing in the rubber member 101. The supporting member 102 deforms when the image bearing member 106 pushes in the rubber member 101. Specifically, the rubber member 101 and the portion L1 (a second supporting portion) of the supporting member 102 are displaced in the direction of the pushing in of the image bearing member 106 (the upward direction in FIG. 2C). This displacement direction is approximately the same as the direction in which the fixed portion A of the cleaning member 103 nips the housing member 104. Thus, at this time, the bent portion 102*a* between the portion L1 and the portion L2 deforms such that the angle between the portion L1 and the portion L2, which is originally 90°, becomes sharper. Further, in the portion L2, the part (a first supporting portion) not in contact with the housing member 104 is subjected to flexural deformation by using a boundary 102*b*, which is between the part (the first portion) in contact with the housing member 104 and the part not in contact with the housing member 104, as a fulcrum.

[Behavior of Cleaning Member According to First Exemplary Embodiment]

Figure 3:
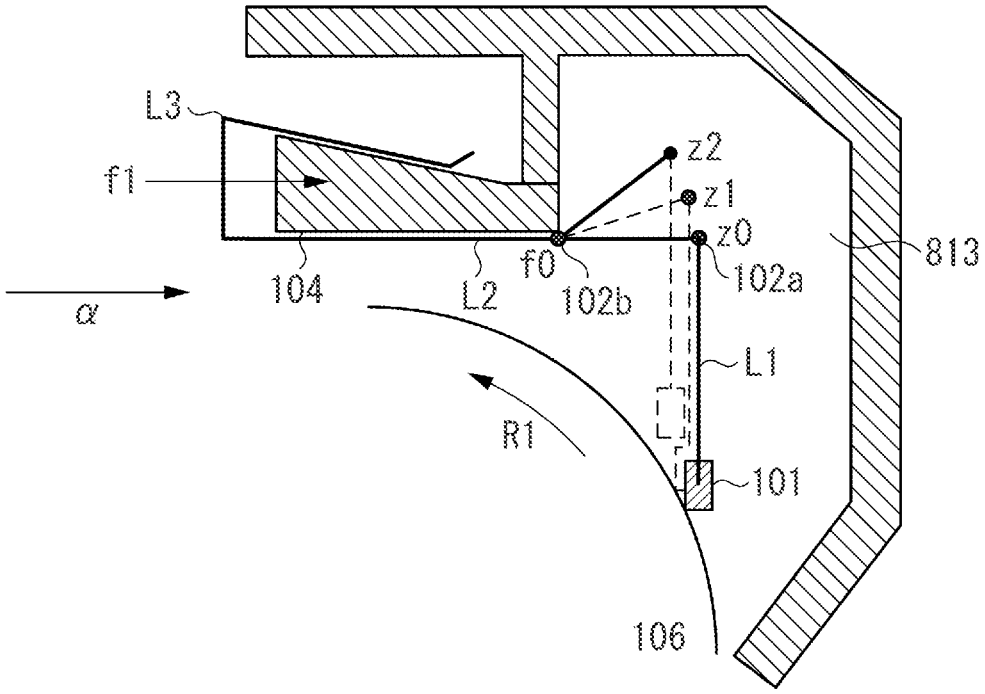
FIG. 3 is a schematic cross-sectional view illustrating a behavior of the cleaning member according to the first exemplary embodiment.

With reference to FIG. 3, the behavior of the cleaning member 103 according to the first exemplary embodiment when the cleaning member 103 slides in contact with the image bearing member 106 will be described. FIG. 3 is a schematic cross-sectional view of the behavior of the cleaning member 103 according to the first exemplary embodiment. Specifically, FIG. 3 is a diagram illustrating a general idea of the behavior of the cleaning member 103 when the image bearing member 106 has rotated in the direction R1.

As described above, when the image bearing member 106 has been attached, the position of the bent portion 102*a* of the cleaning member 103 moves from z0 to z1. If the image bearing member 106 has rotated in the direction R1, the rubber member 101 is subjected to force downstream of the rotational direction R1 of the image bearing member 106 due to the frictional force between the image bearing member 106 and the rubber member 101. This further increases the flexure of the plate metal between the bent portion 102*a* and the bent portion 102*b* (i.e., in the first supporting portion) in the portion L2, and the position of the bent portion 102*a* moves from z1 to z2. At this time, the degree of bending of the bent portion 102*a* and the degree of deformation of the flexural deformation of the first supporting portion increase. Then, the portion L1 and the rubber member 101 are displaced further downstream of the moving direction of the image bearing member 106. If the bent portion 102*a* has bent to be displaced to z1 and z2, force in a direction f1 acts on the plate metal L3. The direction f1 of the force acting on the plate metal L3 and the direction α of insertion of the cleaning member 103 are the same direction. This prevents the cleaning member 103 from coming off the housing member 104.

As described above, in the first exemplary embodiment, the portion L3 of the cleaning member 103 has a bent shape that follows the shape of the housing member 104, and the cleaning member 103 is fixed to the housing member 104 by nipping the housing member 104 in the portion L3. Then, attachment of the image bearing member 106 subjects the portion L2 of the supporting member 102 to flexural deformation using the portion 102*b* as a fulcrum. Then, the image bearing member 106 is driven to rotate, whereby force acts on the rubber member 101. Consequently, the supporting member 102 further deforms, whereby force acts on the cleaning member 103 in the direction f1. The direction of this force is the direction in which the portion L3 (the second portion) of the supporting member 102 hits the housing member 104, and also is a direction opposed to the direction in which the cleaning member 103 comes off the housing member 104. This can prevent the cleaning member 103 from coming off the housing member 104, and also stabilize the position of the supporting member 102, thereby stabilizing the state of contact of the rubber member 101 with the image bearing member 106.

Further, the cleaning member 103 is fixed to the housing member 104 by nipping the housing member 104 in the folded-back portion of the supporting member 102. This prevents the deformation of the supporting member 102, particularly the portion L3, which is the fixed portion A fixed to the housing member 104. Further, the cleaning member 103 and the housing member 104 are not fixed to each other using a fastening member such as the attachment screws 105 as in the comparative example, but are fixed to each other by inserting the housing member 104 into the cleaning member 103 in a sliding manner. This can reduce the number of members and improve the ease of assembly.

The shape of the fixed portion A of the cleaning member 103 fixed to the housing member 104 is not limited to the shape in the first exemplary embodiment, so long as the cleaning member 103 can nip the housing member 104 with certain pressure due to the spring characteristics of the thin plate. In the first exemplary embodiment, the configuration is such that the folded-back portion of the supporting member 102 is folded back in a direction away from the image bearing member 106, but may be folded back in the opposite direction. In this case, a member for holding the portion L2 between the member and the housing member 104 may be separately provided so that when a force is applied by the image bearing member 106, the portion L2 can deform using the portion 102*b* as a fulcrum.

Figure 7A:
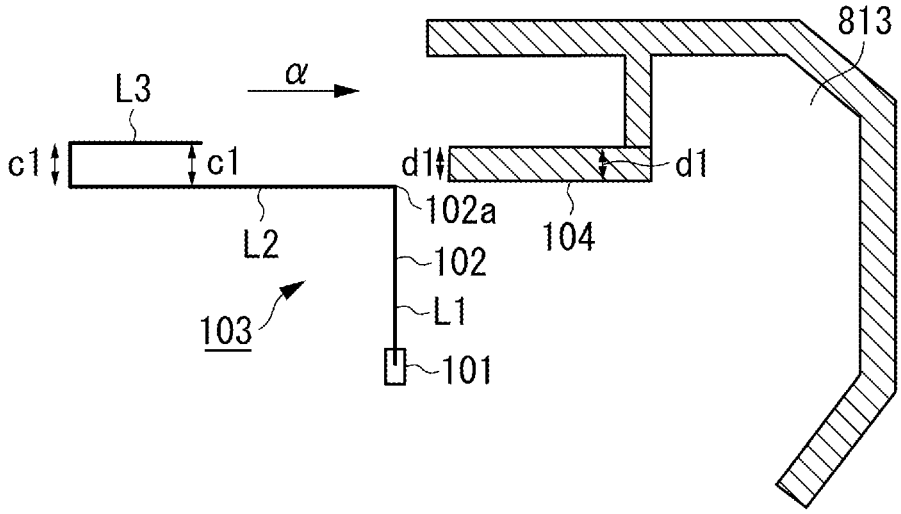
FIGS. 7A and 7B are schematic cross-sectional views illustrating a method of fixing a cleaning member according to the second exemplary embodiment.
Figure 7B:
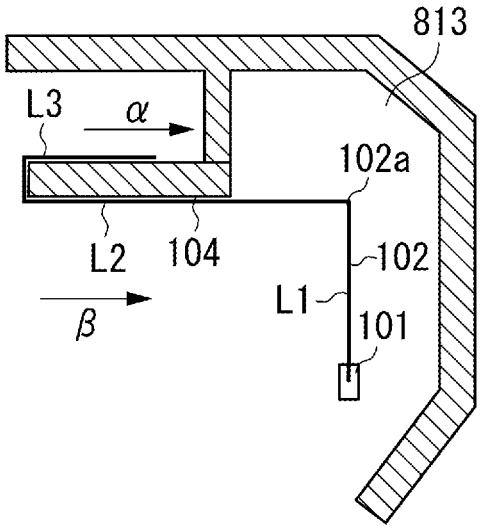
Figure 8:
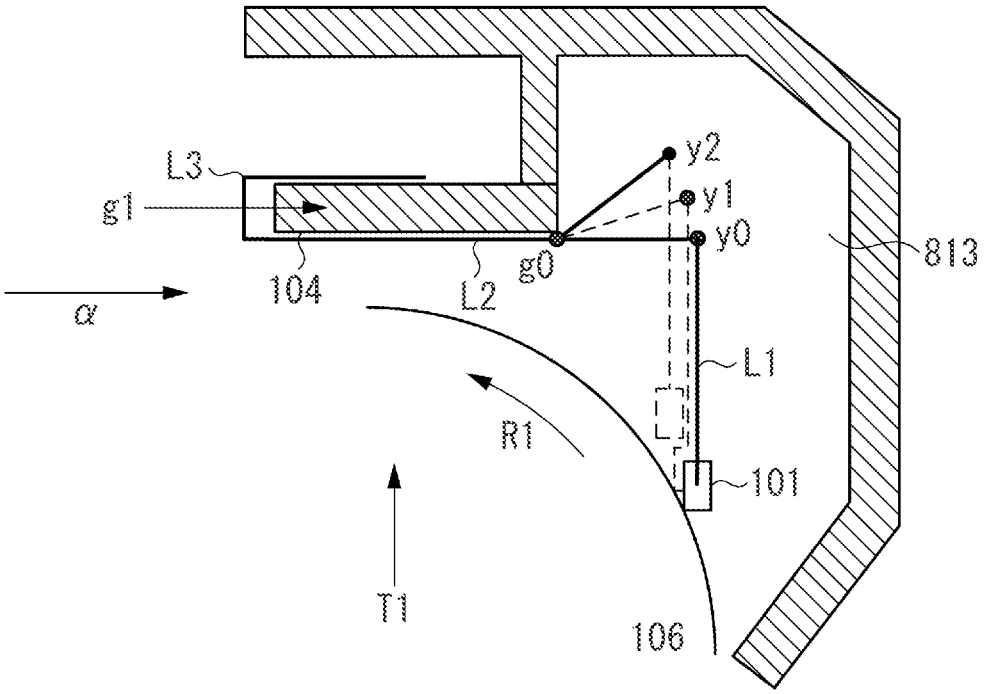
FIG. 8 is a schematic cross-sectional view illustrating a behavior of the cleaning member according to the second exemplary embodiment.

With reference to FIGS. 7A, 7B, and 8, the cleaning member 103 according to a second exemplary embodiment of the present invention will be described. FIGS. 7A and 7B are schematic cross-sectional views of the method of fixing the cleaning member 103 according to the second exemplary embodiment, and the method is illustrated in the sequence of steps. FIG. 8 is a schematic cross-sectional view of the behavior of the cleaning member 103 according to the second exemplary embodiment. Specifically, FIG. 8 is a diagram illustrating a general idea of the behavior of the cleaning member 103 when the image bearing member 106 has rotated in the direction R1. In the following description, the components redundant with those of the first exemplary embodiment are designated by the same numerals and are not described. Unless otherwise described, all matters are similar to those of the first exemplary embodiment.

As illustrated in FIG. 7A, the fixed portion A is folded back to accommodate the shape of the housing member 104. In the second exemplary embodiment, the fixed portion A is folded back such that the space between the first portion and the third portion has a constant width. That is, a recessed shape formed by bending the portion L3 has a constant width c1 from the bottom side to the opening side. Correspondingly, the housing member 104 also has a constant width dl from the end portion that comes into contact with the second portion of the fixed portion A to the end portion on the opposite side. Further, c1 and d1 are set to sizes corresponding to each other (the former is slightly greater in view of ease of assembly). The cleaning member 103 is slid in a direction α in FIG. 7A to insert the housing member 104 into the folded-back portion, thereby attaching the cleaning member 103 to the housing member 104 (FIG. 7B).

As illustrated in FIG. 8, after the cleaning member 103 has been attached to the housing member 104, the image bearing member 106 is attached to the frame member. The image bearing member 106 is inserted into the frame member in a direction (a direction T1 illustrated in FIG. 8) opposed to the direction in which the portion L1 of the supporting member 102 of the cleaning member 103 extends. Then, the image bearing member 106 comes into contact with the rubber member 101 of the cleaning member 103 and is attached to the frame member by pushing in the rubber member 101. When the image bearing member 106 has been attached, the position of the bent portion 102*a* of the cleaning member 103 moves from y0 to y1. If the image bearing member 106 has rotated in the direction R1, the rubber member 101 is subjected to force downstream of the rotational direction R1 of the image bearing member 106 due to the frictional force between the image bearing member 106 and the rubber member 101. This further increases the flexure of the plate metal between the bent portion 102*a* and the bent portion 102*b* (i.e., in the first supporting portion) in the portion L2, and the position of the bent portion 102*a* moves from y1 to y2. At this time, the degree of bending of the bent portion 102*a* and the degree of deformation of the flexural deformation of the first supporting portion increase. Then, the portion L1 and the rubber member 101 are displaced further downstream of the moving direction of the image bearing member 106. If the bent portion 102*a* has bent to be displaced to y1 and y2, force in a direction g1 acts on the plate metal L3. The direction g1 of the force acting on the plate metal L3 and the direction α of insertion of the cleaning member 103 are the same direction. This prevents the cleaning member 103 from moving in a direction β and coming off the housing member 104.

As described above, in the second exemplary embodiment, the portion L3 of the cleaning member 103 has a bent shape that follows the shape of the housing member 104, and the cleaning member 103 is fixed to the housing member 104 by nipping the housing member 104 in the portion L3. Then, attachment of the image bearing member 106 subjects the portion L2 of the supporting member 102 to flexural deformation using the portion 102*b* as a fulcrum. Then, the image bearing member 106 is driven to rotate, whereby force acts on the rubber member 101. Consequently, the supporting member 102 further deforms, whereby force acts on the cleaning member 103 in the direction g1. The direction of this force is the direction in which the portion L3 (the second portion) of the supporting member 102 hits the housing member 104, and also is a direction opposed to the direction in which the cleaning member 103 comes off the housing member 104. This can prevent the cleaning member 103 from coming off the housing member 104, and also stabilize the position of the supporting member 102, thereby stabilizing the state of contact of the rubber member 101 with the image bearing member 106.

The exemplary embodiments of the present invention are not limited to the above image forming apparatus illustrated in FIG. 9, but can also be suitably applied to an intermediate transfer type image forming apparatus using an intermediate transfer belt (an intermediate transfer member), and an image forming apparatus that transfers a toner image onto a sheet material borne and conveyed by a conveying belt (a conveying member). For these image forming apparatuses, the exemplary embodiments of the present invention can be suitably applied not only as a cleaning device for a photosensitive drum but also as a cleaning device that cleans toner attached to the surface of the intermediate transfer belt or the conveying belt. Further, the exemplary embodiments of the present invention are not limited to an image forming apparatus capable of forming a monochromatic image, but can also be suitably applied to an image forming apparatus capable of forming a multicolor image (a color image).

According to the exemplary embodiments of the present invention, it is possible to stabilize the contact of a blade member with a member to be cleaned.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-039183 filed Feb. 28, 2013, which is hereby incorporated by reference herein in its entirety.

What is claimed is:

1. A cleaning member for removing a developer from a surface of a member to be cleaned, the cleaning member comprising:

a blade member configured to come into contact with the member to be cleaned in a direction counter to a moving direction of the member to be cleaned; and a flexible plate-like supporting member configured to support the blade member, the supporting member including one end portion, in which the blade member is provided, an other end portion, which has a fixed portion fixed to a frame member, and a bent portion, which is configured to extend in a direction parallel to a longitudinal direction of the blade member and which is located between the one end portion and the other end portion and located outwardly away from the surface of the member to be cleaned with respect to a line segment connecting the fixed portion and a contact portion, in which the blade member comes into contact with the member to be cleaned, wherein the fixed portion is arranged downstream of the moving direction of the member to be cleaned relative to the contact portion, and wherein the fixed portion has a folded-back shape that allows a part of the frame member to be nipped.

2. The cleaning member according to claim 1, wherein, when the supporting member is deformed by a force applied to the blade member by the member to be cleaned, a first supporting portion, which is a part between the bent portion and the fixed portion, is subjected to flexure.

3. The cleaning member according to claim 1, wherein the fixed portion includes a first portion, which extends in a direction away from the bent portion, a second portion, which extends from a leading end of the first portion in a direction away from the member to be cleaned, and a third portion, which extends from a leading end of the second portion in a direction toward the bent portion, and wherein the fixed portion nips the part of the frame member between the first portion and the third portion.

4. The cleaning member according to claim 3, wherein the closer to a leading end of the third portion, the narrower a space between the first portion and the third portion.

5. The cleaning member according to claim 1, wherein the supporting member is a metal leaf spring.

6. A cleaning device for use in an image forming apparatus, the cleaning device comprising:

(i) a frame member;

(ii) a cleaning member for removing a developer from a surface of a member to be cleaned, the cleaning member comprising:

a blade member configured to come into contact with the member to be cleaned in a direction counter to a moving direction of the member to be cleaned; and a flexible plate-like supporting member configured to support the blade member, the supporting member including one end portion, in which the blade member is provided, an other end portion, which has a fixed portion fixed to the frame member, and a bent portion, which is configured to extend in a direction parallel to a longitudinal direction of the blade member and which is located between the one end portion and the other end portion and located outwardly away from the surface of the member to be cleaned with respect to a line segment connecting the fixed portion and a contact portion, in which the blade member comes into contact with the member to be cleaned, wherein the fixed portion is arranged downstream of the moving direction of the member to be cleaned relative to the contact portion, and wherein the fixed portion has a folded-back shape that allows a part of the frame member to be nipped; and (iii) a storage member configured to store the developer removed from the member to be cleaned by the cleaning member.

7. The cleaning device according to claim 6, wherein, when the supporting member is deformed by a force applied to the blade member by the member to be cleaned, a first supporting portion, which is a part between the bent portion and the fixed portion, is subjected to flexure.

8. The cleaning device according to claim 6, wherein the fixed portion includes a first portion, which extends in a direction away from the bent portion, a second portion, which extends from a leading end of the first portion in a direction away from the member to be cleaned, and a third portion, which extends from a leading end of the second portion in a direction toward the bent portion, and herein the fixed portion nips the part of the frame member between the first portion and the third portion.

9. The cleaning device according to claim 8, wherein the closer to a leading end of the third portion, the narrower a space between the first portion and the third portion.

10. The cleaning device according to claim 6, wherein the supporting member is a metal leaf spring.

11. A process cartridge attachable to and detachable from an image forming apparatus, the process cartridge comprising:

(i) a photosensitive member;

(ii) a frame member; and (iii) a cleaning member for removing a developer from a surface of the photosensitive member, the cleaning member comprising:

a blade member configured to come into contact with the photosensitive member in a direction counter to a moving direction of the photosensitive member; and a flexible plate-like supporting member configured to support the blade member, the supporting member including one end portion, in which the blade member is provided, an other end portion, which has a fixed portion fixed to the frame member, and a bent portion, which is configured to extend in a direction parallel to a longitudinal direction of the cleaning member and which is located between the one end portion and the other end portion and located outwardly away from the surface of the photosensitive member with respect to a line segment connecting the fixed portion and a contact portion, in which the blade member comes into contact with the photosensitive member, wherein the fixed portion is arranged downstream of the moving direction of the photosensitive member relative to the contact portion, and wherein the fixed portion has a folded-back shape that allows a part of the frame member to be nipped.

12. The process cartridge according to claim 11, wherein, when the supporting member is deformed by a force applied to the blade member by the photosensitive member, a first supporting portion, which is a part between the bent portion and the fixed portion, is subjected to flexure.

13. The process cartridge according to claim 11, wherein the fixed portion includes a first portion, which extends in a direction away from the bent portion, a second portion, which extends from a leading end of the first portion in a direction away from the photosensitive member, and a third portion, which extends from a leading end of the second portion in a direction toward the bent portion, and wherein the fixed portion nips the part of the frame member between the first portion and the third portion.

14. The process cartridge according to claim 13, wherein the closer to a leading end of the third portion, the narrower a space between the first portion and the third portion.

15. The process cartridge according to claim 11, wherein the supporting member is a metal leaf spring.

16. An image forming apparatus for forming an image on a recording medium using a developer, the image forming apparatus comprising:

(i) a member to be cleaned;

(ii) a frame member; and (iii) a cleaning member for removing a developer from a surface of the member to be cleaned, the cleaning member comprising:

a blade member configured to come into contact with the member to be cleaned in a direction counter to a moving direction of the member to be cleaned; and a flexible plate-like supporting member configured to support the blade member, the supporting member including one end portion, in which the blade member is provided, an other end portion, which has a fixed portion fixed to the frame member, and a bent portion, which is configured to extend in a direction parallel to a longitudinal direction of the blade member and which is located between the one end portion and the other end portion and located outwardly away from the surface of the member to be cleaned with respect to a line segment connecting the fixed portion and a contact portion, in which the blade member comes into contact with the member to be cleaned, wherein the fixed portion is arranged downstream of the moving direction of the member to be cleaned relative to the contact portion, and wherein the fixed portion has a folded-back shape that allows a part of the frame member to be nipped.

17. The image forming apparatus according to claim 16, wherein, when the supporting member is deformed by a force applied to the blade member by the member to be cleaned, a first supporting portion, which is a part between the bent portion and the fixed portion, is subjected to flexure.

18. The image forming apparatus according to claim 16, wherein the fixed portion includes a first portion, which extends in a direction away from the bent portion, a second portion, which extends from a leading end of the first portion in a direction away from the member to be cleaned, and a third portion, which extends from a leading end of the second portion in a direction toward the bent portion, and wherein the fixed portion nips the part of the frame member between the first portion and the third portion.

19. The image forming apparatus according to claim 18, wherein the closer to a leading end of the third portion, the narrower a space between the first portion and the third portion.

20. The image forming apparatus according to claim 16, wherein the supporting member is a metal leaf spring.

21. The image forming apparatus according to claim 16, wherein the member to be cleaned is a photosensitive member on which a developer image is to be formed.

* * * * *